US008102326B2

(12) United States Patent
Schadler et al.

(10) Patent No.: US 8,102,326 B2
(45) Date of Patent: Jan. 24, 2012

(54) BROADCAST ANTENNA ELLIPTICITY CONTROL APPARATUS AND METHOD

(75) Inventors: John Schadler, Raymond, ME (US); Andre Skalina, Portland, ME (US)

(73) Assignee: SPX Corporation, Charlotte, NC (US)

( * ) Notice: Subject to any disclaimer, the term of this patent is extended or adjusted under 35 U.S.C. 154(b) by 642 days.

(21) Appl. No.: 12/209,442

(22) Filed: Sep. 12, 2008

(65) Prior Publication Data

US 2010/0066637 A1 Mar. 18, 2010

(51) Int. Cl.
*H01Q 21/26* (2006.01)

(52) U.S. Cl. ..... 343/797; 343/816; 343/820; 343/853

(58) Field of Classification Search ..... 343/778, 343/797, 816, 820, 852, 853, 860, 862; 333/160
See application file for complete search history.

(56) References Cited

U.S. PATENT DOCUMENTS 2,903,695 A 9/1959 Jamieson
5,382,959 A 1/1995 Pett et al.
5,416,453 A 5/1995 Quan
6,297,774 B1 * 10/2001 Chung ..... 343/700 R
2006/0181472 A1 8/2006 Baird et al.
2007/0254587 A1 11/2007 Schadler et al.

FOREIGN PATENT DOCUMENTS

GB 654498 A 6/1951

* cited by examiner

*Primary Examiner* — Michael C Wimer
(74) *Attorney, Agent, or Firm* — Baker & Hostetler LLP

(57) ABSTRACT

The present invention provides a phaser pack for an elliptically polarized antenna that includes a first structural component, a second structural component and a cylindrical inner conductor. The first structural component includes a recess, coupled to an input port, that forms a first portion of a cylindrical conductive path, while the second structural component includes a recess, coupled to a plurality of output ports, that forms a second portion of the cylindrical conductive path. The recesses of the first and second structural components form a continuous cylindrical conductive path when the first and second structural components are mated. The cylindrical inner conductor includes a plurality of tee junctions and a plurality of transition segments, coupled to the input port and the plurality of output ports, disposed within the continuous cylindrical conductive path to form a coaxial conductor that provides different phase delays to at least two of the plurality of output ports.

17 Claims, 6 Drawing Sheets

BROADCAST ANTENNA ELLIPTICITY CONTROL APPARATUS AND METHOD

FIELD OF THE INVENTION

The present invention relates generally to broadcasting of radio-frequency electromagnetic signals. More particularly, the present invention relates to apparatus and methods for controlling broadcast signal ellipticity in single-feed elliptically polarized broadcast antennas.

BACKGROUND OF THE INVENTION

Early in the television era, testing indicated that vertical polarization of broadcast signals was inferior to horizontal in view of the relative immunity of the latter to multipath degradation in urban canyons. This judgment drove broadcast design for some decades. Recently, digital television (DTV) has been chosen as a replacement for traditional analog television (ATV), adding the possibility of higher resolution and reduced noise thanks to the capability of digital signal processing to overcome transmission limitations of ATV bandwidth and propagation.

Initially, it was observed that circular polarization (CP) added no benefit to DTV transmission—indeed, it was determined that CP was detrimental to eight-level vestigial sideband modulation (8-VSB) signals, selected by the Advanced Television Systems Committee (ATSC) for U.S. broadcasting, since CP appeared to be intolerant of multipath. In particular, the vertical component within a circularly polarized signal is intrinsically more susceptible than the horizontal component to multipath distortion, so that use of CP is likely to render DTV signals unrecoverable—even moreso than CP used for the more accommodating ATV signals. This led to selection of horizontal polarization (HP) as the standard for DTV.

Subsequent advances in echo canceling, however, have made 8-VSB much more tolerant of multipath, so that other forms of transmission, including circular polarization, are now feasible. At the same time, U.S. broadcasters have been enabled to add mobile-receiver television service to the previously enabled fixed-receiver service within digital channels already licensed. This new technology (In-Band Mobile TV), may empower broadcasters to establish a mobility advantage over cable competition, and to compete against recently initiated 700 MHz mobile services.

In achieving reliable service in a mobile application, elliptical polarization has distinct advantages over HP. Elliptical polarization (the limit is CP, where the vertical and horizontal components are equal in magnitude) allows receiving antenna orientation and change of orientation to be substantially unimportant to successful broadcast reception. Lower vertical component energy is still desirable—that is, ellipticity is preferably not at a value of one. However, known techniques for distribution of power to elliptically polarized, high power, single-feed broadcast antennas intrinsically provide substantially equal power in vertical and horizontal components, or require unequal power splitters—typically one per radiator—to adjust component energy. Similar results can be achieved in the alternative with dual-feed antennas, incurring instead penalties of higher wind loading, weight, and/or material cost associated with remote power splitters or like solutions. What is needed is a way to adjust relative signal strength between the two component parts of an elliptically polarized signal that is highly efficient, and that still permits the use of preferred styles of broadcast radiators.

SUMMARY OF THE INVENTION

Embodiments of the present invention provide a phaser pack for an elliptically polarized antenna that includes a first structural component, a second structural component and a cylindrical inner conductor. The first structural component includes a recess, coupled to an input port, that forms a first portion of a cylindrical conductive path, while the second structural component includes a recess, coupled to a plurality of output ports, that forms a second portion of the cylindrical conductive path. The recesses of the first and second structural components form a continuous cylindrical conductive path when the first and second structural components are mated. The cylindrical inner conductor includes a plurality of tee junctions and a plurality of transition segments, coupled to the input port and the plurality of output ports, disposed within the continuous cylindrical conductive path to form a coaxial conductor that provides different phase delays to at least two of the plurality of output ports.

Further embodiments of the present invention provide a method for distributing an elliptically polarized electromagnetic signal to a pair of orthogonal, crossed-dipole radiators disposed on an antenna panel that includes defining a continuous coaxial signal path from an input port to four output ports, establishing a uniform outer-conductor inner diameter over at least a portion of the signal path, including at least a portion encompassing a first signal branching locus and a plurality of second signal branching loci, establishing a coaxial inner conductor having a diameter variation that compensates for impedance changes associated with signal branchings within the signal path, grouping the output ports in proximal, parallel pairs spaced apart by a distance approximating a midband wavelength of a specified electromagnetic signal, and applying a differential delay, having a spatial value corresponding to a specified part of a midband wavelength of the electromagnetic signal, to the respective output ports of the proximal pairs thereof.

There have thus been outlined, rather broadly, features of the invention, in order that the detailed description thereof that follows may be better understood, and in order that the present contribution to the art may be better appreciated. There are, of course, additional features of the invention that will be described below and that will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments, and of being practiced and carried out in various ways. It is also to be understood that the phraseology and terminology employed herein, as well as the abstract, are for the purpose of description, and should not be regarded as limiting.

As such, those skilled in the art will appreciate that the conception upon which this disclosure is based may readily be utilized as a basis for the designing of other structures, methods, and systems for carrying out the several purposes of the present invention. It is important, therefore, that the claims be regarded as including such equivalent constructions insofar as they do not depart from the spirit and scope of the present invention.

DETAILED DESCRIPTION OF THE INVENTION

Embodiments of the present invention provide a phaser pack for an elliptically polarized antenna that delivers equal amplitude and appropriate phase to each dipole within a set of orthogonal crossed-dipole radiators, to advantageously control the amount of ellipticity radiating from the antenna.

Figure 1:
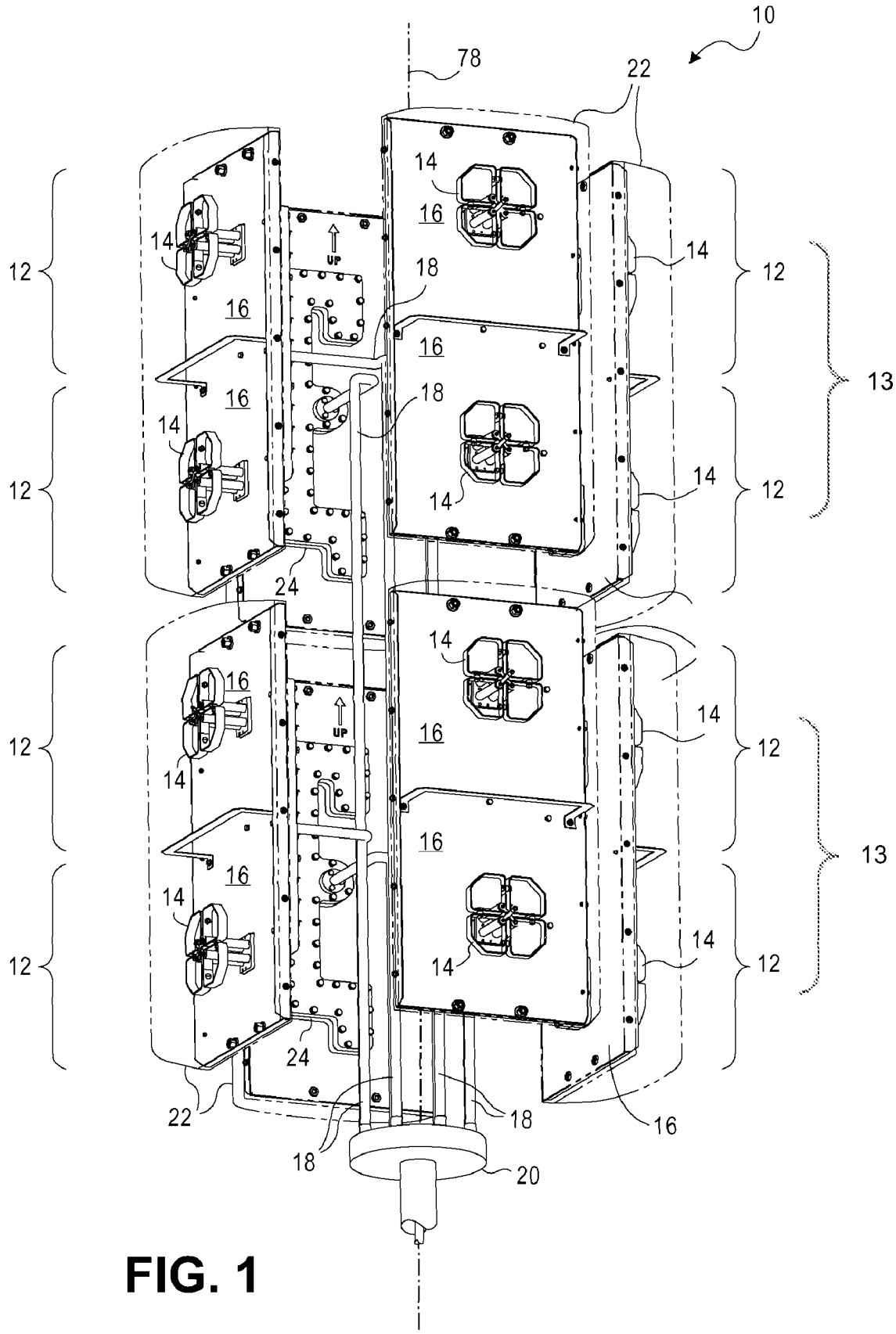
FIG. 1 presents a perspective view of an antenna, according to an embodiment of the present invention.

FIG. 1 presents a perspective view of an antenna, according to an embodiment of the present invention. In this embodiment, broadcast antenna 10 includes a plurality of antenna panels 13, each of which includes a set of radiators 14 oriented with substantially uniform azimuthal distribution. Each antenna panel 13 may be further divided into respective bays 12, each housing a radiator 14, that are backed by reflector 16 and fed, generally, by signal lines 18. In alternative embodiments, each antenna panel 13 may include one or more additional sets of radiators 14, such as two sets, three sets, four sets, etc., one or more additional bays 12, etc.

In the depicted embodiment, signal lines 18 are preferably coaxial and are shown leading directly from the power splitter 20. Other signal distribution architectures are also contemplated, such as, for example, the use of equal-length signal lines 18, a traveling wave distribution, an antenna-centered splitter 20, etc. For simplicity, structural support is not shown, and the radome-covered, reflector-backed radiator assemblies are spaced apart sufficiently to allow viewing of internal parts. In many embodiments, a framework is provided to stabilize the antenna, and the reflectors are closely coupled to one another azimuthally and vertically.

In the depicted embodiment, each radiator 14 emits a substantial portion of its energy into a single primary lobe, generally perpendicular to and away from vertical antenna axis 78. The distribution of radiators 14 in the axial direction is preferably symmetric, with deviations therefrom affecting propagation uniformity. Generally, three or four (or more) antenna panels 13, such as those depicted in the four-around embodiment of FIG. 1, are used to approximate omnidirectional azimuthal signal distribution. This embodiment advantageously produces substantially uniform elliptical polarization at both mid-lobe and intermediate azimuths.

Generally, single-direction beam patterns, peanut beam patterns, and other non-omnidirectional beam patterns may also be produced using other radiator placements and feed arrangements, and embodiments of the present invention contemplate such arrangements as well. The term "axial ratio" generally refers to the quality of circular polarization, and, as used herein, is defined as the maximum received signal variation over all polarization orientations. Axial ratio affects both transmitter power usage and receiving antenna sensitivity to orientation. Additionally, the term "polarization ratio," as used herein, is defined as the ratio of vertical polarization to horizontal polarization.

In a preferred embodiment, a phaser pack 24 is disposed behind each antenna panel 13, and provides phase-adjusted signals to each of the radiators 14. In this embodiment, each phaser pack 24 includes an input port and four output ports, i.e., two ports for each radiator 14, in order to provide two output signals, with desired phase and substantially uniform power distribution, to each radiator 14. Application of a single broadcast signal to multiple ports differing in phase may be advantageously achieved using a single feed line 18 and a phaser pack 24.

The vertical spacing of bays 12 and antenna panels 13 is generally defined by the radiator-to-radiator dimension of the phaser packs 24 and the vertical spacing between reflector-backed assembly centers, which may group the bays 12 non-uniformly in some embodiments. Vertical spacing may be referenced to one wavelength of a center frequency of the antenna 10, for example, at midband, or may be varied over a moderate range to modify signal distribution as a function of elevation. Similarly, feed timing to pairs of bays 12 disposed on antenna panel 13 may be adjusted by varying feed line 18 length to further modify beam elevation characteristics. Additionally, beam tilt, null fill, vertical null, etc., may be provided in this fashion. The embodiment depicted in FIG. 1 may be advantageously employed over at least portions of the UHF broadcast band.

The number of bays 12 in an antenna 10 are advantageously selected depending upon the intended application, from two bays 12 (e.g., one antenna panel 13), suitable for a low-power or backup system, for example, to eight or more bays 12 (four or more antenna panels 13), with the latter typically better suited to a primary, high-power system where high gain and wide service coverage are also desired. Embodiments of the present invention provide at least 5 KW power handling per phaser pack 24, with the great bulk of this energy emitted, for example, as a voltage standing wave ratio (VSWR)≦1.1:1 over a specified range. In a four-around antenna panel configuration, as depicted in FIG. 1, for example, each appropriately-driven bay 12 can radiate about 10 KW; accordingly, an eight-bay (four panel) antenna can radiate about 80 KW. Gain provides an effective radiated power (ERP) significantly above this power level, so these values are comparable to those expected for full-power broadcasting. Alternative embodiments may include odd numbers of bays 12 per antenna 10, as well as coplanar triple-radiator or quadruple-radiator configurations with appropriate signal distribution arrangements. Either traveling-wave or corporate feed may be applicable to such embodiments.

Figure 2:
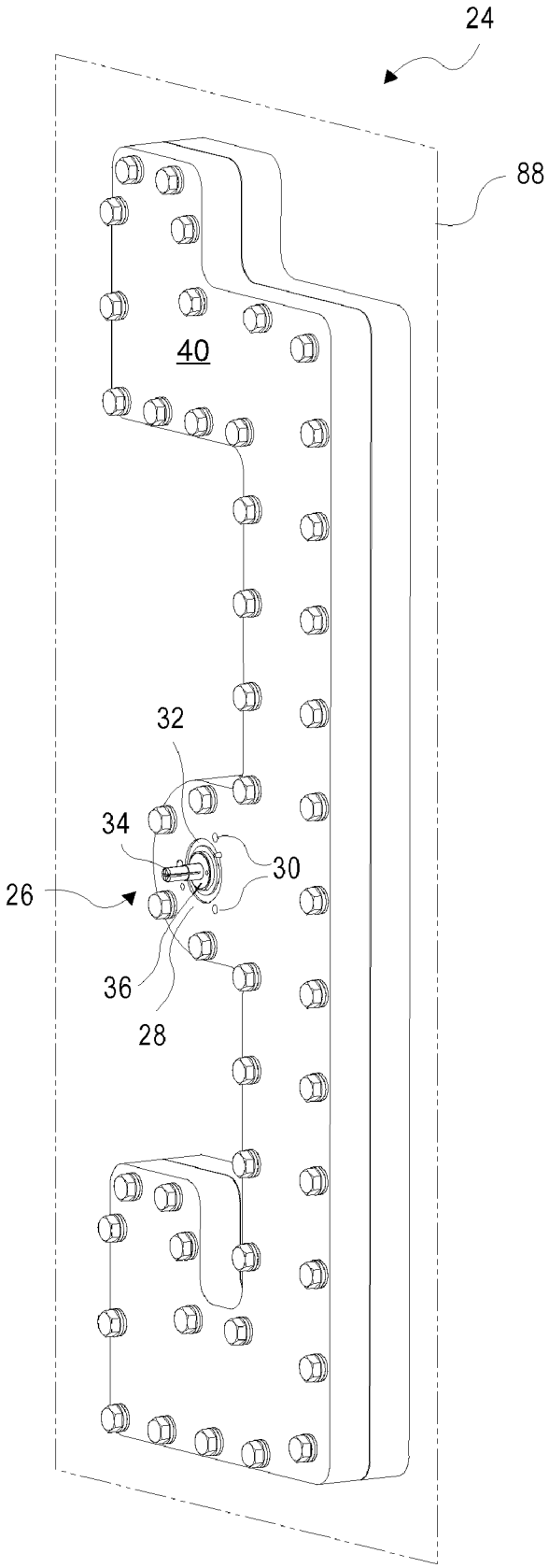
FIGS. 2 and 3 present matching perspective views of a phaser pack, according to an embodiment of the present invention.
Figure 3:
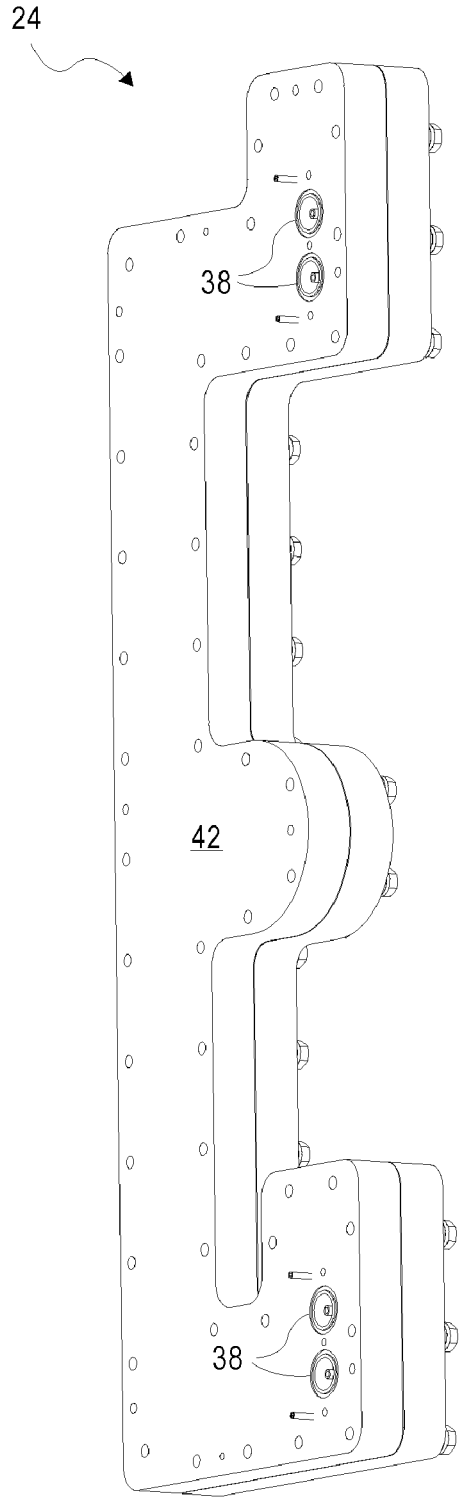

FIGS. 2 and 3 present matching perspective views of a phaser pack, according to an embodiment of the present invention. Phaser pack 24 includes a single coaxial input port 26 and four coaxial output ports 38. Input port 26 may advantageously employ an Electronic Industry Association (EIA) standard coaxial connection arrangement compatible with moderate power broadcasting. Input port 26 includes an outer conductor coupling, e.g., a flange. The outer conductor coupling consists of a portion 28 of the phaser pack 24 surface proximal to the port 26, along with three surrounding screw holes 30 and a recessed area 32 compatible with an O-ring fitted between the coupling and a mating coaxial connector outer coupling or flange (not shown). The input port 26 also includes an EIA-compatible inner conductor fitting 34, e.g., a pin or bullet, mateable to an EIA-compatible coaxial connector inner conductor receptacle (not shown). An insulator 36 centers the inner conductor fitting or bullet 34 within the port 26.

In one embodiment, the input port size is rated ⅞ inch (22 mm), which refers to the approximate inner diameter of the outer conductor of the coaxial line to which a port of this size (or another coaxial line) is commonly connected. In an alternative embodiment, a 1⅝ inch (41 mm) input port is used as part of an enlarged phaser pack 24 that supports a significantly increased power level (e.g., doubled power level). For these respective power levels, radiators 14 are mated with phaser pack 24 output ports 38 of ¾ inch and ⅞ inch rating.

In this embodiment, four, ¾ inch fittings form the output ports 38, with the mounting surface accommodated to the mounting flanges of the radiators 14 and aligned therewith through the reflectors 16. The output ports 38, particularly in lower power versions, may be advantageously sized with a view towards ease of manufacture, mechanical strength requirements, power transmission losses, etc. In other embodiments, still larger or smaller sizes of input and output connective devices may be accommodated. Where preferred, the output ports 38 may be terminated in flange-and-bullet structures similar to the input port 26 terminations, or in other styles of connectors, and the output signals may be attached to coaxial signal transmission lines rather than directly to coaxial input ports of radiators 14 as shown. A dividing plane 88 represents the mating surface between an input-side component 40 and an output-side component 42. In a preferred embodiment, input and output side components 40, 42 are clam shell components.

Figure 4:
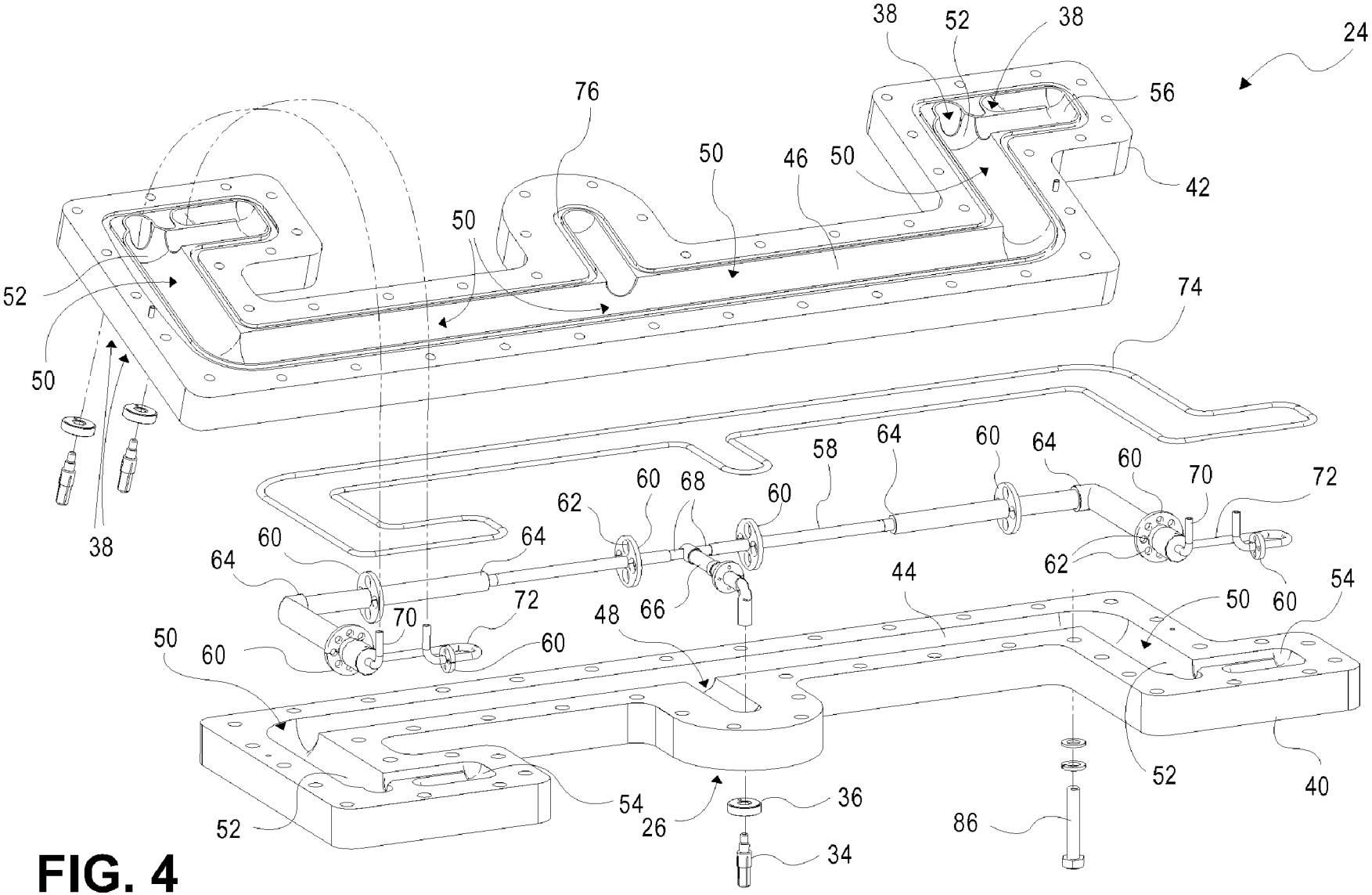
FIG. 4 presents an exploded, perspective view of a phaser pack, according to an embodiment of the present invention.

FIG. 4 presents an exploded, perspective view of a phaser pack, according to an embodiment of the present invention. Input-side component 40 and output-side component 42 include respective primary recesses 44, 46, each forming a half-cylindrical cutout of substantially uniform radius along a specified path in the dividing plane 88 of FIG. 2. Generally, the surfaces of primary recesses 44, 46 form an outer conductor in which an inner conductor 58 is disposed. In this embodiment, primary recess 44 accommodates input port 26, while primary recess 46 accommodates the four output ports 38. Additionally, primary recesses 44, 46 include locus 48, at which location an inner conductor 38 tee junction is disposed, and two routes 50 leading to loci 52, at which locations an additional inner conductor 38 tee junction is disposed. In one embodiment, primary recesses 44, 46 may be reduced in diameter to form primary recess output feeds 54, 56, respectively, from loci 52 to the location of the four output ports 38. In another embodiment, primary recesses 44, 46 are not reduced in diameter; accordingly, primary recess output feeds 54, 56 have the same diameter as primary recesses 44, 46 and are merely extensions of those recesses.

As noted above, the outer conductor is formed by primary recesses 44, 46. These recesses are generally smooth combinations of linear and arcuate segments having substantially continuous transitions from segment to segment, advantageously producing a low incidence of reflections, resonances, unintended impedance variations, and related signal-altering defects in phaser pack 24. If sufficiently uniform, the continuous seams between the mated, concentric portions of the outer conductor do not introduce point reflections.

In a preferred embodiment, the profile of the outer conductor, i.e., the surfaces of primary recess 44, 46, is cylindrical. In alternative embodiments, the outer conductor profile may be square, hexagonal, etc. For example, a square profile may be particularly effective in speeding fabrication, which advantageously lowers cost. In one embodiment, a square-profiled recess may be formed entirely within the input-side component 40, while the output-side component 42 may be substantially flat. In this embodiment, the second component advantageously does not require inletting of a signal path. Conversely, a square-profiled recess may be formed entirely within the output-side component 42, while the input-side component 40 may be substantially flat.

These embodiments of the present invention may be contrasted with a conventional assembly made from multiple sections of semi-rigid coaxial line, for example, and pieced together with fabricated unions. Such a conventional assembly demands greater artisanship in cutting and assembling component parts, tends to be difficult to keep smoothly continuous, and even difficult to inspect visually, at direction changes, diameter changes, and other critical points. The many circular joints required of a conventional assembly likewise require either leak-prone seals or permanent bonds such as solder joints, each limiting examination and limited in reliability.

Inner conductor 58 is disposed within the primary recesses 44, 46 and primary recess output feeds 54, 56, to form a branched, coaxial line from the input port 26 to the four output ports 38. In the depicted embodiment, inner conductor 58 is positioned within primary recesses 44, 46 by a plurality of substantially rigid, nonconductive, preferably low-dielectric constant spacers 60. These spacers 60 are representative and are not intended to be limiting with regard to placement, material, design detail, number, etc. In one embodiment, spacers 60 include pass holes 62 to permit free flow of pressurization gas and to reduce loss and reflection by lowering the effective dielectric constant of each spacer 60. In another embodiment, spacers 60 may be fabricated as single pieces, optionally including a radial cut from center to edge, and flexed to place them around the inner conductor 58. In another embodiment, alternative structures such as dielectric foam, preferably spiral wrapped or having open cells, may be used to properly locate inner conductor 38 within primary recesses 44, 46, and may provide other advantageous features, such as, for example, electrical transparency, mechanical stability, low resistance to gas flow, etc.

Spacers 60 may be fitted to retention provisions (not shown) located on inner conductor 58, and may be captured by commensurate retention provisions (not shown) disposed on the surface of primary recesses 44, 46 and primary recess output feeds 54, 56. Since retention provisions in the form of ring recesses, for example, can represent appreciable lumped impedances within the coaxial structure, the combination of shape and dielectric constant of spacers 60, as well as retention provision configuration, may be selected to control and/or cancel signal reflections at each such location. For example, raised ring portions on inner conductor 58 may be used instead of, or in addition to, ring recesses within primary recesses 44, 46 and primary recess output feeds 54, 56 to provide compensating impedance lumps or to serve as retention provisions.

Loci 48, 52 are dimensioned to accommodate respective inner conductor tee junctions, and, as such, are characterized by impedance changes. Primary recesses 44, 46 and primary recess output feeds 54, 56 maintain substantially constant diameter over most of their length, while inner conductor 58 changes diameter at the inner conductor tee junction 68 as well as the four inner conductor transition sections 64. The changes in the inner conductor diameter at these locations provide a succession of step changes in impedance, and provide useful adjustments with little penalty in the form of reflection losses. For example, in one embodiment, the first inner conductor tee junction 68 has a standard impedance at the tee junction input 66, e.g., 50 ohms, and has twice the impedance, e.g., 100 ohms, at the tee junction outputs 68. Because impedance is proportional to the common log of the diameter ratio of the outer and inner conductors, inner conductor tee junction 68 advantageously exhibits low reflection when the outer conductor diameter remains constant while the diameters of the tee junction outputs 68 are reduced, as compared to the tee junction input 66, to a value that roughly doubles the line impedance. In this embodiment, the two tee junction outputs 68 are in parallel and approximate the impedance of the tee junction input 66. This impedance is then reduced by inserting step transformers 64, which increases the diameter of the inner conductor 58 to achieve a desired impedance, e.g., 38 ohms, leading into the second inner conductor tee junctions 71.

In this embodiment, the second inner conductor tee junctions 71 combine power and impedance splitting with a transformer function. Specifically, the second inner conductor tee junctions 71 reduce inner conductor diameter to form a tee that applies two loads in parallel, so that the phaser pack 24 output impedance matches a desirable value for a radiator input impedance at a specific power level, while the impedance transformation at the second inner conductor tee junctions 71 maintains a low reflection value over the working frequency range of the antenna 10. The second inner conductor tee junctions 71 each have two outputs, i.e., a shorter, inner conductor segment 70 coupled to one output port 38, and a longer, inner conductor segment 72 coupled to the other output port 38. This configuration, along with the extended controlled-impedance path followed by the inner conductor segments 72, establishes the phase differential that produces the elliptical polarization pattern. The inner conductor segments 72 permit phase adjustment by minor adjustments in the fabrication layout of each of the major components.

Importantly, changing the lengths of the inner conductor segments 72 and the primary access output feeds 54, 56, advantageously changes the phase delay to one of the output ports 38, which varies the proportion of horizontal to vertical signal power and, therefore, the ellipticity of the antenna 10.

Embodiments of the present invention may be pressurized, and thus preferably sealed to an extent sufficient to keep leakage low during normal operation. Numerous alternative sealing methods between components are anticipated, such as welding, gluing, fabrication of close-tolerance metal-to-metal joints, and the like. Cost mitigation, ease of assembly, and ease of rework may be provided through use of resilient packing, also referred to as gaskets, along with moderate precision of fabrication, so that the precision assures acceptable electrical performance while the gaskets seal against gas leakage separately. Potentially useful styles of packing include deformable metal, akin to the types used with automobile spark plugs, single-use electrical crimp connectors, and the like, as well as rectangular-profile elastomeric cutouts and strips, and O-rings.

In an embodiment, an O-ring 74 is disposed in secondary recess 76 of output-side component 42. O-ring 74 may be a closed loop having a round cross section, or, alternatively, O-ring 74 may be provided in cord form that may be laid-in dry, greased, cut to fit and glued end-to-end to form a closed loop, branched, or otherwise configured to minimize leakage in an embodiment after assembly. While the secondary recess 76 shown has its full depth in only one component, i.e., output-side component 42, other embodiments may have equal depth in each component 40, 42, unequal depth in the respective components, etc.

In a preferred embodiment, phase pack 24 includes two generally similar halves, i.e., input-side and output-side components 40, 42, differing primarily in port configuration. Input-side and output-side components 40, 42 have substantially planar, rectangular, mirrored "clamshell" mating faces and a planar external surface on the output-side component 42 compatible with attachment of the phaser pack 24 to the back of a reflector 16 of the antenna 10. In other embodiments, the output-side component 42 may serve a more structural or more functional purpose, such as providing load-bearing support or acting as a part of a reflector 16.

Figure 5:
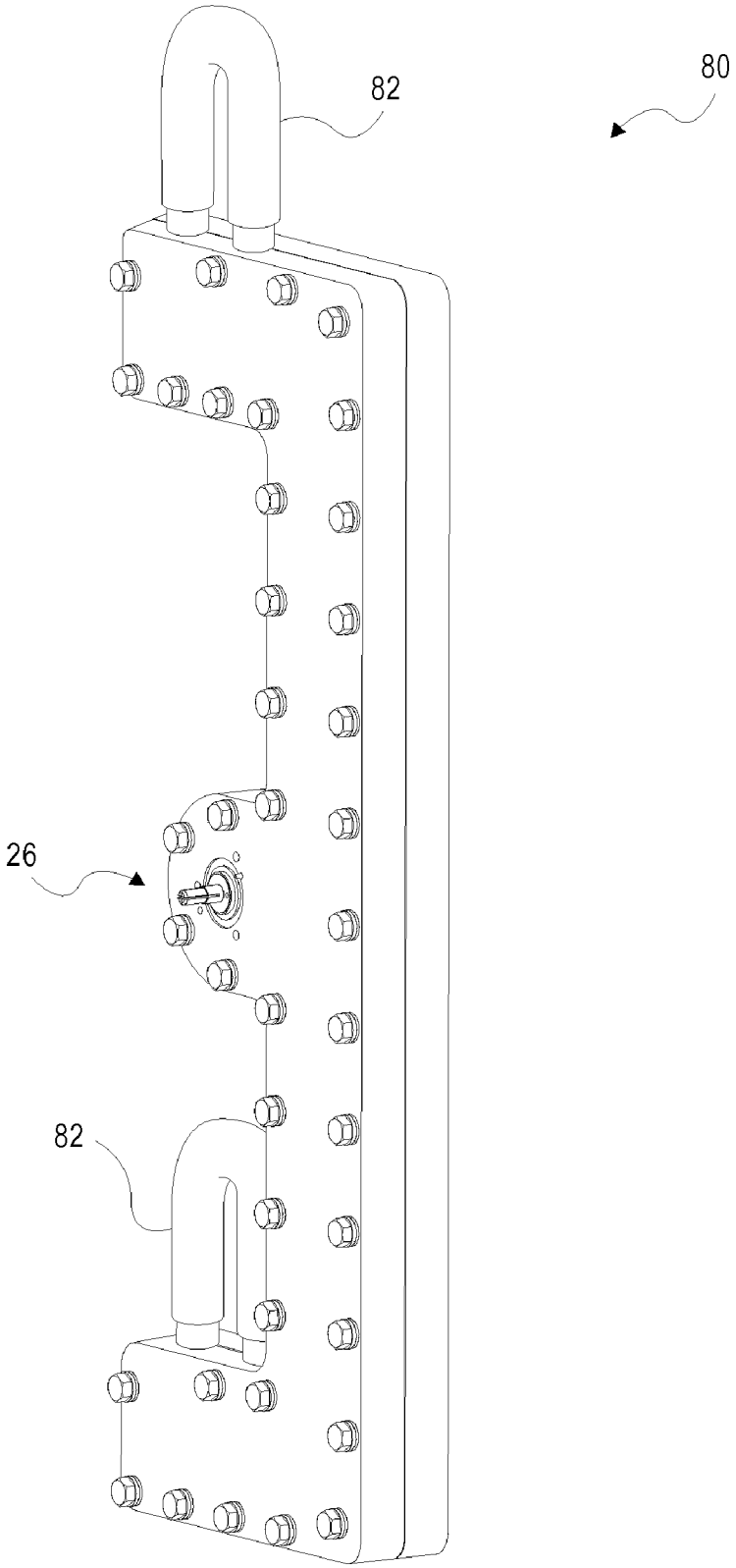
FIG. 5 presents a perspective view of a phaser pack, according to another embodiment of the present invention.

FIG. 5 presents a perspective view of a phaser pack, according to another embodiment of the present invention. In this embodiment, phaser pack 80 includes removable phase delay structures 82 that vary the ellipticity. For example, removable phase delay structures 82 may have differing fixed-length conductors, adjustable or variable-length conductors, etc. Adjustable phase delay structures 82 are useful for testing and development purposes, while non-adjustable phase delay structures 82 are useful for permanent installations.

Figure 6:
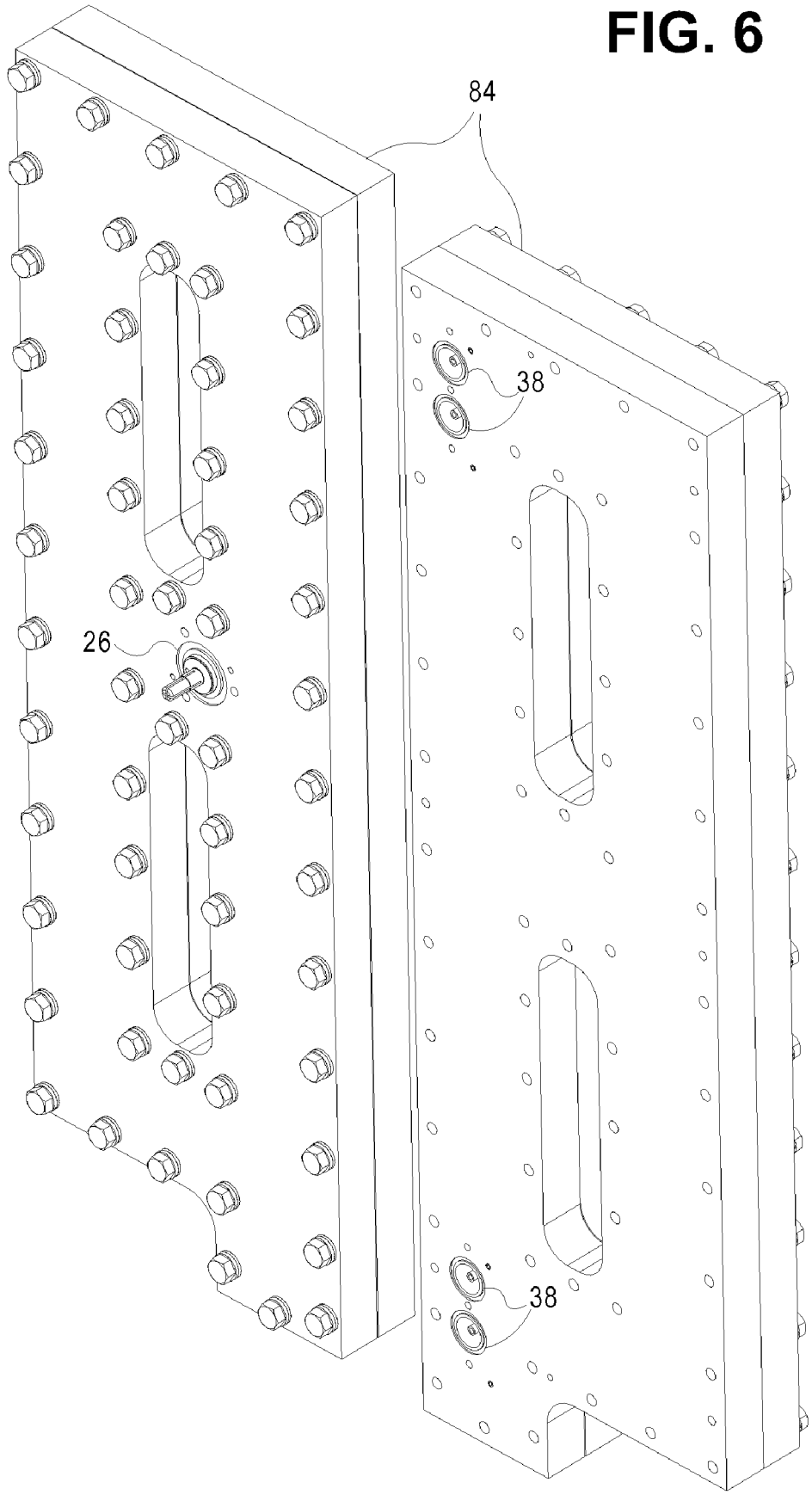
FIG. 6 depicts matching perspective views of a phaser pack, according to another embodiment of the present invention.

FIG. 6 depicts matching perspective views of a phaser pack, according to another embodiment of the present invention. In this embodiment, phaser pack 84 is a prism that envelopes the primary recesses 44, 46 of the input-side and output-side components 40, 42. In an alternative embodiment, the inner conductor 58 may have substantially constant diameter, while the diameters of the primary recesses 44, 46 change to produce the desired impedance at each location within phaser pack 84. Similarly, while the lengths of the signal paths in the embodiment shown are relatively low, alternative embodiments may use either longer or even shorter signal paths in carrying the signal from input 26 to phase-controlled outputs 38.

Generally, both layout and minimum length of the signal paths within the phaser packs 24, 80, 84 may be bounded by a requirement for separation between transition segments 64. Additionally, one or more of the straight-line portions of the signal paths of phaser pack 24 may be arcuate in some embodiments. Further, phaser packs 24, 80, 84 have input 26 and outputs 38 depicted on opposite components; in other embodiments, the orientation of input port 26 and output ports 38 may be determined accordingly to other considerations.

Advantageously, the aforementioned embodiments of the present invention generally provide a coaxial inner conductor 58 of arbitrary net shape, having a substantially uninterrupted construction after manufacture, surrounded by a coaxial outer conductor that, while of similarly uninterrupted construction after manufacture, is assembled from a plurality of components that each include a longitudinally split subset of the outer conductor assembly. Phaser packs 24, 80, 84 represent simple, readily designed, low-profile embodiments of the invention, which advantageously place two, in-phase coplanar radiators 14 roughly a wavelength apart while setting a particular value of phase delay in the signal applied to the second input of each radiator 14 with respect to the first, thereby determining the ellipticity of the emitted beam from that radiator 14, and of the overall antenna 10.

Figure 7:
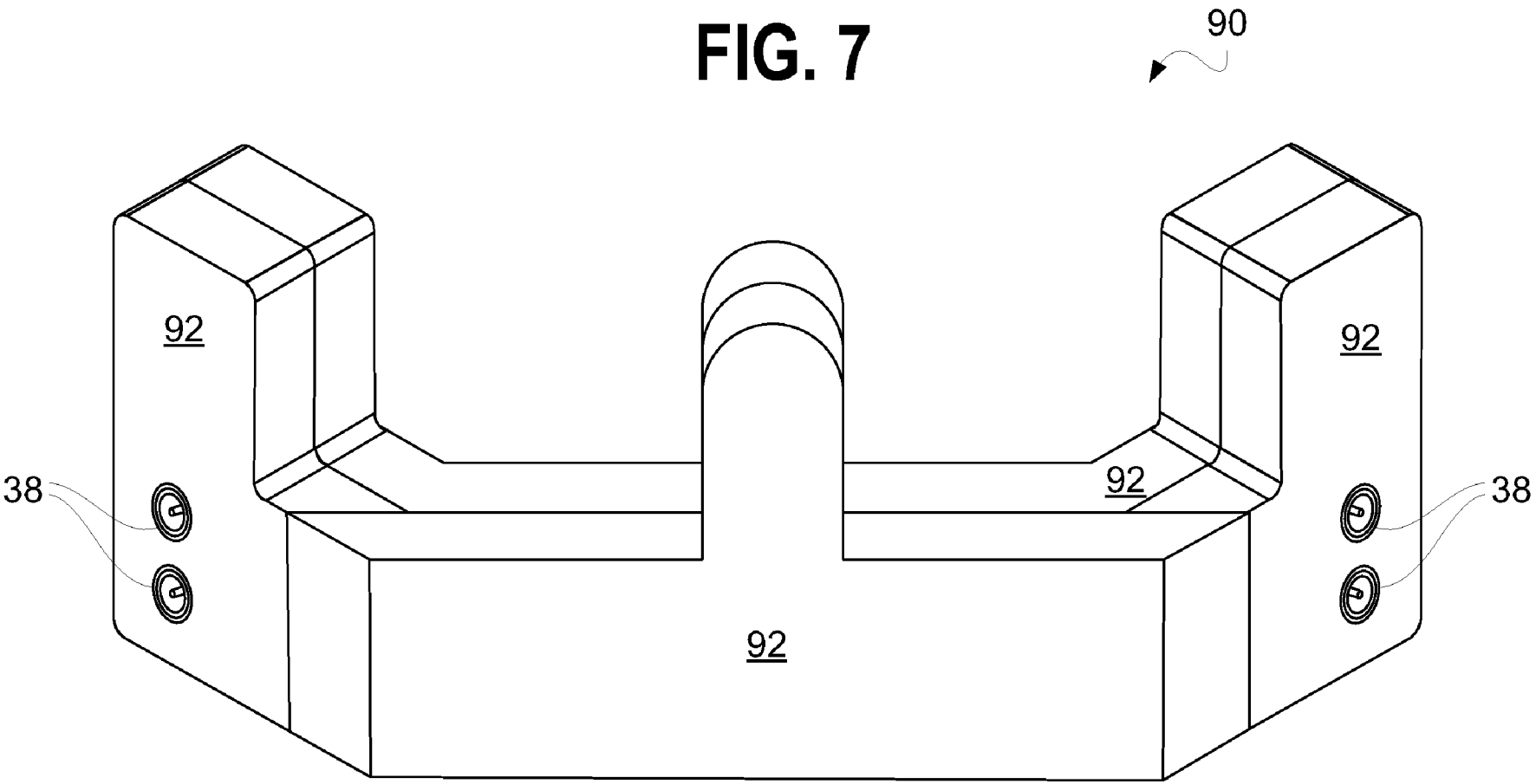
FIG. 7 presents a perspective view of a phaser pack, according to another embodiment of the present invention.

FIG. 7 presents a perspective view of a phaser pack, according to another embodiment of the present invention. Phaser pack 90 includes one or more major bends to place the radiators 14 at right angles. The dividing plane 88 of the embodiments of FIGS. 1-6, identified in FIG. 2, denotes a two-part outer assembly having a planar mating surface between the parts. However, the non-coplanar nature of the respective radiator ports 32, as well as other considerations, may dictate that the outer assembly be constructed from more than two components, such as, for example, components 92, as illustrated in FIG. 7. Sealing gaskets for such arrangements may have complex form; for optimized sealing, die-cut flat packing or an O-ring 74 in cord form, as discussed above, may be preferred. Such variations fall are contemplated by the present invention. Preferable seal components include silicone rubber, buna-n, or any comparable material meeting life and performance parameters, and may be augmented with lubricating and/or sealing materials such as petroleum jelly.

Choice of materials for the large components of the phaser pack, such as the housing and inner conductors, as indicated above, may be any readily applied castable metal alloy for each of the outer parts and the inner conductor, and readily-machined metal alloys for connector parts. Alternative fabrication methods, such as machining from billets, sintering of near-final moldings, stamping, forging, etc., may require alternative materials. In other embodiments, nonconductive materials such as polyesters and epoxies, reinforced with fibers or other fillers, may be used to form the large components, which may then preferably receive conductive coatings on signal path surfaces. Similarly, metallic or carbon fiber filler added to epoxides may improve overall conductivity and/or robustness of bonding of conductive coating materials.

Power handling capabilities for those embodiments based on conductively coated components, with structures using nonconductors and weak conductors, is important. Indeed, in some embodiments, cast metal components, formed from aluminum or zinc alloys, for example, may benefit from plating with tin and silver to maximize surface conductivity. In other embodiments, external temperature extremes, pollution, salt spray, and other factors may bear on material choice. Factors such as material and fabrication cost may also be considered. For very low cost, low precision, low power, low durability, and/or high-volume applications, materials such as vacuum formed plastic sheet, rotary-formed plastics, and the like may satisfy requirements.

The numerous machine screws 86 shown holding the components together may be fabricated from a suitable nonconductive material or any metal or alloy, such as a stainless steel or bronze, having compatible electromotive properties and desirable mechanical properties. In other embodiments, a relatively deep flange, added approximately above secondary recess 76, for example, may assure adequate joint uniformity while reducing the number of screws needed. In still other embodiments, clips, lips, alignment keys, or other attachment features may replace screws at least in part. In yet other embodiments, such as for minimal-cost, non-repairable units, final assembly may include welding or other substantially permanent assembly methods in lieu of removable fastenings. In some such embodiments, at least some resilient seals 74 and associated secondary recesses 76 may be obviated.

When employed for the UHF television band, the phaser pack 24 may preferably have a passband as great as the range from 470 MHz to 794 MHz, i.e., roughly 324 MHz (or 26%), so that a one-wavelength spacing between radiators, and thus between port pairs, at midband may be on the order of 0.5 meters (1.5 feet). For narrower passbands within the UHF television band, this dimension may be slightly changed. For lower S-band, the spacing may be less than 0.2 meters, while for VHF television, it may be 6 meters or more. Power issues such as voltage limits imposed by gap dimensions may predominate at high frequencies, while physical size challenges may limit application at low frequencies. The phaser pack 24 is nonetheless well suited to the repurposed upper television channels, for example, where these issues do not dominate.

The many features and advantages of the invention are apparent from the detailed specification, and, thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and, accordingly, all suitable modifications and equivalents may be resorted to that fall within the scope of the invention.

What is claimed is:

1. A phaser pack for an elliptically polarized antenna, comprising:

a first structural component including a recess, coupled to an input port, forming a first portion of a cylindrical conductive path;

a second structural component including a recess, coupled to a plurality of output ports, forming a second portion of the cylindrical conductive path, the recesses of the first and second structural components forming a continuous cylindrical conductive path when the first and second structural components are mated; and a cylindrical inner conductor including a plurality of tee junctions and a plurality of transition segments, coupled to the input port and the plurality of output ports, disposed within the continuous cylindrical conductive path to form a coaxial conductor that provides different phase delays to at least two of the plurality of output ports.

2. The phaser pack of claim 1, wherein the plurality of tee junctions include a first tee junction coupled to the input port, a second tee junction coupled to first and second output ports, and a third tee junction coupled to third and fourth output ports.

3. The phaser pack of claim 2, wherein the plurality of transition segments include pairs of first, second and third transition segments respectively coupled to the first tee junction and the second and third tee junctions.

4. The phaser pack of claim 3, wherein the second tee junction is coupled to the first and second output ports by respective cylindrical conductors of different lengths, and the third tee junction is coupled to the third and fourth output ports by respective cylindrical conductors of different lengths.

5. The phaser pack of claim 1, wherein the plurality of output ports include four output ports arranged as pairs of output ports disposed on opposing ends of the second structural component, the pairs of output ports being separated by approximately 1.3 feet.

6. The phaser pack of claim 1, wherein the two phase delays differ by approximately 60° at a passband center frequency of an orthogonal, crossed-dipole radiator coupled to two output ports.

7. The phaser pack of claim 1, further comprising a sealing gasket, wherein the second structural component includes a sealing recess, formed on a mating surface and surrounding the recess, to receive the sealing gasket.

8. The phaser pack of claim 7, wherein the first structural component includes a sealing recess, formed on a mating surface and surrounding the recess, to receive the sealing gasket.

9. The phaser pack of claim 1, wherein the input port and the output ports include coaxial fittings.

10. An antenna panel for an elliptically polarized antenna, comprising:

a reflector;

a first orthogonal crossed-dipole radiator having two input ports;

a second orthogonal crossed-dipole radiator having two input ports; and a phaser pack, having an input port and a four output ports coupled to the input ports of the first and second radiators, the phaser pack including:

a first structural component including a recess, coupled to the input port, forming a first portion of a cylindrical conductive path, a second structural component including a recess, coupled to the output ports, forming a second portion of the cylindrical conductive path, the recesses of the first and second structural components forming a continuous cylindrical conductive path when the first and second structural components are mated, and a cylindrical inner conductor including three tee junctions and at least three transition segments, coupled to the input port and the output ports, disposed within the continuous cylindrical conductive path to form a coaxial conductor that provides two signals to each radiator, each having a different phase delay.

11. The antenna panel of claim 10, wherein a first tee junction is coupled to the input port, a second tee junction is coupled to first and second output ports, and a third tee junction coupled to third and fourth output ports.

12. The antenna panel of claim 11, wherein the transition segments include pairs of first, second and third transition segments respectively coupled to the first tee junction and the second and third tee junctions.

13. The antenna panel of claim 12, wherein the second tee junction is coupled to the first and second output ports by respective cylindrical conductors of different lengths, and the third tee junction is coupled to the third and fourth output ports by respective cylindrical conductors of different lengths.

14. The antenna panel of claim 10, wherein the input port and output ports include coaxial fittings.

15. A method for distributing an elliptically polarized electromagnetic signal to a pair of orthogonal, crossed-dipole radiators disposed on an antenna panel, comprising:

defining a continuous coaxial signal path from an input port to four output ports;

establishing a uniform outer-conductor inner diameter over at least a portion of the signal path, including at least a portion encompassing a first signal branching locus and a plurality of second signal branching loci;

establishing a coaxial inner conductor having a diameter variation that compensates for impedance changes associated with signal branchings within the signal path;

grouping the output ports in proximal, parallel pairs spaced apart by a distance approximating a midband wavelength of a specified electromagnetic signal; and applying a differential delay, having a spatial value corresponding to a specified part of a midband wavelength of the electromagnetic signal, to the respective output ports of the proximal pairs thereof.

16. The method of claim 15, further comprising:

arranging the coaxial signal path to include a center line that generally lies in a dividing plane perpendicular to the direction of travel of the branched output portions of the divided signal path; and providing a partition of the outer conductor into two discrete components through the signal path center line in the dividing plane; and providing a continuous, substantially gas-tight seal between the respective components.

17. The method of claim 15, further comprising:

providing a plurality of joints between respective ports and input and output devices, substantially sealable against gas leakage, and substantially matchable to electromagnetic feeds and loads over a frequency range.

* * * * *